US008913765B2

(12) United States Patent
Wei et al.

(10) Patent No.: US 8,913,765 B2
(45) **Date of Patent: *Dec. 16, 2014**

(54) EARPHONE

(71) Applicants: Tsinghua University, Beijing (CN); Hon Hai Precision Industry Co., Ltd., New Taipei (TW)

(72) Inventors: Yang Wei, Beijing (CN); Xiao-Yang Lin, Beijing (CN); Kai-Li Jiang, Beijing (CN); Shou-Shan Fan, Beijing (CN)

(73) Assignees: Tsinghua University, Beijing (CN); Hon Hai Precision Industry Co., Ltd., New Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 13/924,821

(22) Filed: Jun. 24, 2013

(65) Prior Publication Data

US 2014/0140564 A1 May 22, 2014

(30) Foreign Application Priority Data

Nov. 20, 2012 (CN) ..... 2012 1 04712913

(51) Int. Cl.
*H04R 25/00* (2006.01)

(52) U.S. Cl.
USPC ..... 381/164; 381/370; 381/380

(58) Field of Classification Search
USPC ..... 381/150, 164, 370, 380
See application file for complete search history.

(56) References Cited

U.S. PATENT DOCUMENTS

| | | | | |
|---|---|---|---|---|
| 7,876,912 | B2 | 1/2011 | Liu et al. | |
| 8,019,097 | B2 * | 9/2011 | Jiang et al. | 381/164 |
| 8,208,661 | B2 * | 6/2012 | Jiang et al. | 381/164 |
| 8,300,854 | B2 * | 10/2012 | Jiang et al. | 381/164 |
| 8,300,855 | B2 | 10/2012 | Liu et al. | |
| 8,553,912 | B2 | 10/2013 | Wang et al. | |
| 8,625,822 | B2 * | 1/2014 | Jiang et al. | 381/164 |
| 2005/0201575 | A1 | 9/2005 | Koshida et al. | |
| 2006/0233388 | A1 | 10/2006 | Liow et al. | |
| 2010/0067714 | A1 | 3/2010 | Cheng | |
| 2010/0086166 | A1 | 4/2010 | Jiang et al. | |
| 2010/0311002 | A1 | 12/2010 | Jiang et al. | |
| 2011/0033069 | A1 | 2/2011 | Liu et al. | |
| 2011/0051961 | A1 | 3/2011 | Jiang et al. | |
| 2011/0054659 | A1 | 3/2011 | Carlson et al. | |
| 2012/0250907 | A1 | 10/2012 | Jiang et al. | |
| 2012/0250908 | A1 | 10/2012 | Jiang et al. | |
| 2013/0129119 | A1 | 5/2013 | Miyatake et al. | |
| 2013/0216074 | A1 | 8/2013 | Homare Kon | |

FOREIGN PATENT DOCUMENTS

| | | |
|---|---|---|
| JP | 11-300274 | 11/1999 |
| JP | 2005-57479 | 3/2005 |
| JP | 3808493 | 5/2006 |

(Continued)

*Primary Examiner* — Suhan Ni
(74) *Attorney, Agent, or Firm* — Novak Druce Connolly Bove + Quigg LLP

(57) ABSTRACT

An earphone includes a loudspeaker, a signal process, an audio signal input port, and a driving port. The loudspeaker includes a thermoacoustic device disposed in a housing. The signal processor is electrically connected to the loudspeaker to provide signal to the loudspeaker. The audio input port is electrically connected to the signal processor to provide audio signal. The driving port is electrically connected to the signal processor to provide driving signal. The thermoacoustic device includes a substrate, and the substrate defines a number of grooves, a sound wave generator is suspended on the grooves.

20 Claims, 15 Drawing Sheets

(56) References Cited

FOREIGN PATENT DOCUMENTS

| | | |
|---|---|---|
| JP | 2008-167252 | 7/2008 |
| JP | 2009-141880 | 6/2009 |
| JP | 2010-74831 | 4/2010 |
| JP | 2010-93804 | 4/2010 |
| JP | 2010-288270 | 12/2010 |
| JP | 2011-41269 | 2/2011 |
| JP | 2012-39272 | 2/2012 |
| JP | 2012-94942 | 5/2012 |
| JP | 2012-209923 | 10/2012 |
| TW | 209093 | 7/1993 |
| TW | M299999 | 10/2006 |
| TW | 200644701 | 12/2006 |
| TW | 200725861 | 7/2007 |
| TW | 200743677 | 12/2007 |
| TW | 201018256 | 5/2010 |
| TW | 201029481 | 8/2010 |
| TW | 201043763 | 12/2010 |
| TW | 201143474 | 12/2011 |
| TW | 201240480 | 10/2012 |

* cited by examiner

EARPHONE

RELATED APPLICATIONS

This application claims all benefits accruing under 35 U.S.C. §119 from China Patent Application No. 201210471291.3, filed on Nov. 20, 2012 in the China Intellectual Property Office, the contents of which are hereby incorporated by reference. This application is related to commonly-assigned applications entitled, "EARPHONE", filed Jun. 24, 2013 Ser. No. 13/924,782; "EARPHONE", filed Jun. 24, 2013 Ser. No. 13/924,789, the contents of the above commonly-assigned applications are hereby incorporated by reference.

BACKGROUND

1. Technical Field

The present disclosure relates to earphones and, particularly, to a carbon nanotube based earphone.

2. Description of Related Art

Conventional earphone generally includes an earphone housing and an sound wave generator disposed in the earphone housing. The earphones can be categorized by shape into ear-cup (or on-ear) type earphones, earphones, ear-hanging earphones. The earphones can be disposed in the ears of a user. The ear-cup type earphones and ear-hanging earphones are disposed outside and attached to the ears of a user. The ear-cup type earphones have circular or ellipsoid ear-pads that completely surround the ears. The ear-hanging type earphones have ear-pads that sit on top of the ears. The earphones can also be categorized as wired earphones and wireless earphones.

The earphone housing generally is a plastic or resin shell structure defining a hollow space therein. The sound wave generator inside the earphone housing is used to transform electrical signals into sound pressures that can be heard by human ears. Sound wave generators can be categorized according to working principles: electro-dynamic sound wave generators, electromagnetic sound wave generators, electrostatic sound wave generators and piezoelectric sound wave generators. However, all known sound wave generators use mechanical vibrations to produce sound waves and rely on "electro-mechanical-acoustic" conversion. The electro-dynamic sound wave generators are most widely used. However, the structure of the electric-powered sound wave generator is constricted by configurations of magnetic fields and magnets which are often heavy in weight.

Carbon nanotubes (CNT) are a novel carbonaceous material and have received a great deal of interest since the early 1990s. Carbon nanotubes have interesting and potentially useful electrical and mechanical properties, and have been widely used in many different fields.

What is needed, therefore, is to provide an earphone having a simple lightweight structure.

BRIEF DESCRIPTION OF THE DRAWINGS

Many aspects of the present earphone can be better understood with reference to the following drawings. The components in the drawings are not necessarily to scale, the emphasis instead being placed upon clearly illustrating the principles of the present earphone.

DETAILED DESCRIPTION OF EXEMPLARY EMBODIMENTS

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Reference will now be made to the drawings to describe, in detail, embodiments of the present earphone.

Figure 1:
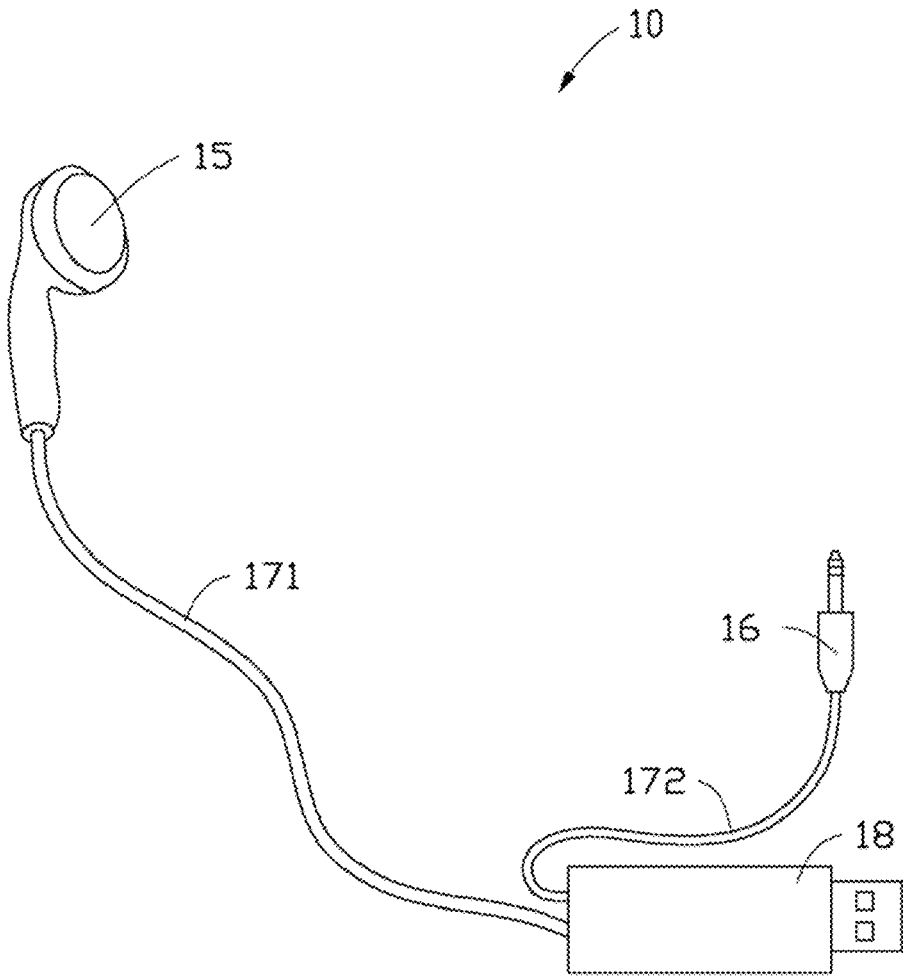
FIG. 1 is a schematic structural view of an earphone.
Figure 2:
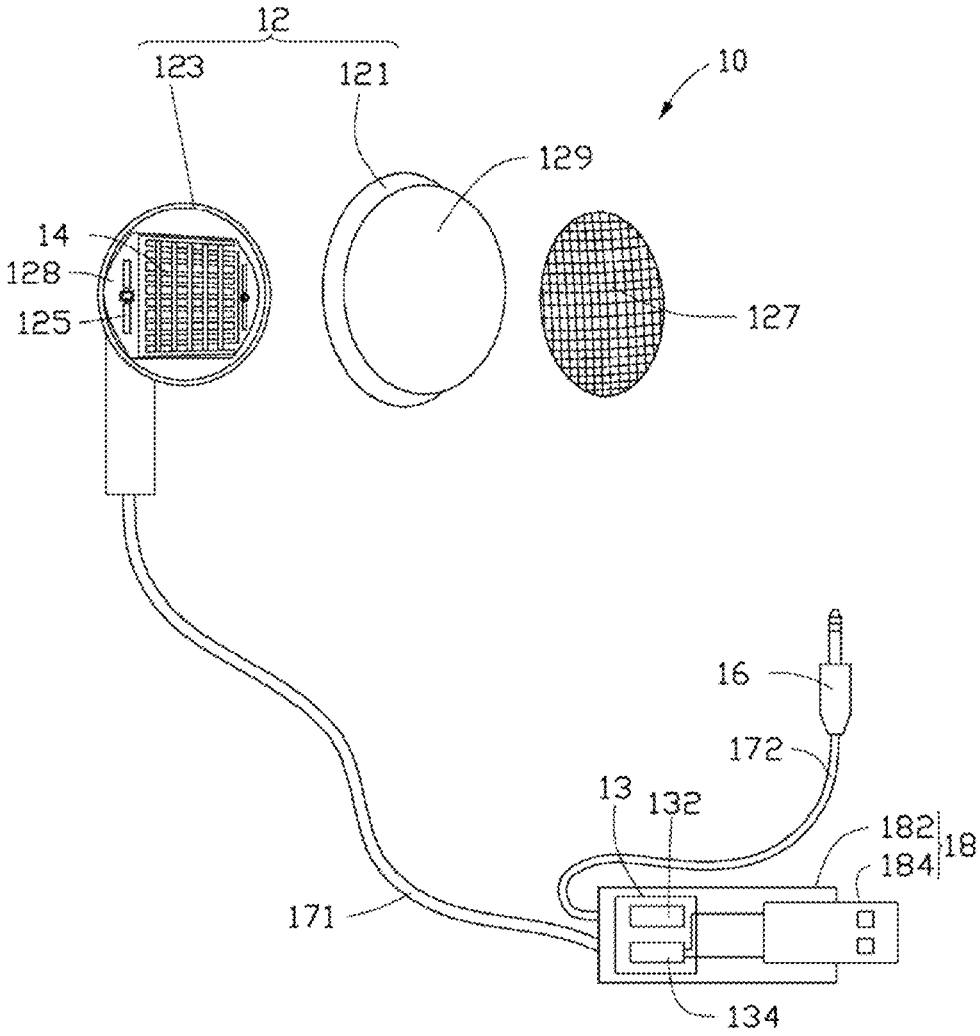
FIG. 2 is an exploded view of the earphone of FIG. 1.

FIGS. 1 and 2 show one embodiment of an earphone 10. The earphone 10 includes a loudspeaker 15, an audio input port 16, and a driving port 18. The loudspeaker 15 is electrically connected to the driving port 18 via a first earphone cable 171, and the audio input port 16 is electrically connected to the driving port 18 via a second earphone cable 172. The audio input port 16 is used to transfer the audio signal into the loudspeaker 15, and the driving port 18 is used to transfer the driving signal into the loudspeaker 15.

The loudspeaker 15 includes a thermoacoustic device 14 disposed in a housing 12. The housing 12 has a hollow structure and can be made of lightweight but strong plastic or resin. The housing 12 defines an opening 129 to transfer the sound wave out of the housing 12. The thermoacoustic device 14 is received in the housing 12 and spaced from the opening 129. The housing 12 includes a front shell 121 and a back shell 123. The opening 129 is defined in the front shell 121, and the thermoacoustic device 14 can be located on the back shell 123. Furthermore, a protective cover 127 can cover the opening 129 to protect the thermoacoustic device 14.

The thermoacoustic device 14 is accommodated in the housing 12. The thermoacoustic device 14 can be fixed on the back shell 123 through a carrier element 128. The carrier element 128 can be fixed onto the back shell 123. In one embodiment, the carrier element 128 can be a printed circuit board, and the thermoacoustic device 14 can be fixed on the printed circuit board via soldering method or a binder. The printed circuit board includes a plurality of contact electrodes 125, and the thermoacoustic device 14 is electrically connected to the first earphone cable 171 through the plurality of contact electrodes 125.

Figure 3:
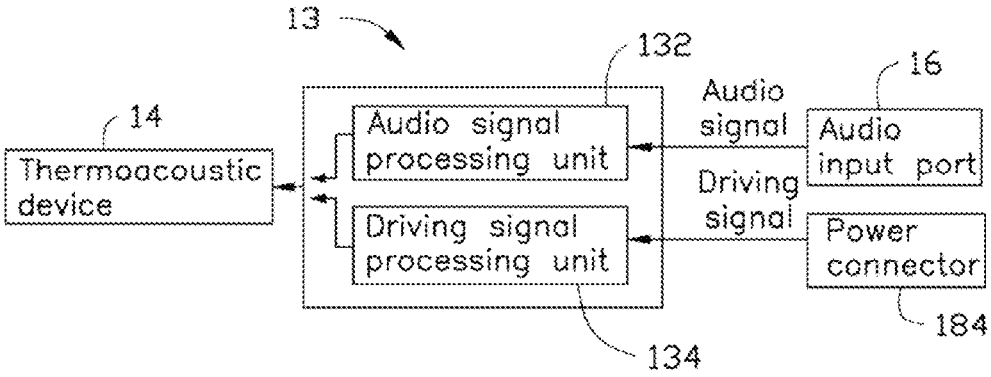
FIG. 3 shows a flowchart of signal processing program of the earphone of FIG. 1.

FIG. 3 shows that the driving port 18 includes a shell 182, and a signal processor 13 received in the shell 182. The driving port 18 also defines a power connector 184. The signal processor 13 is sealed by the shell 182, and the power connector 184 is electrically connected to the signal processor 13 to supply current. The thermoacoustic device 14 is electrically connected to the signal processor 13 to receive a signal. In one embodiment, the power connector 184 can be universal serial bus connector. The signal processor 13 can be fixed on a printed circuit board (not shown) in the shell 182, and the universal serial bus connector is electrically connected to the signal processor 13 by soldering method. Furthermore, the signal processor 13 can also be integrated into the universal serial bus connector. The size of the signal processor 13 can be smaller than 1 square millimeter, such as 49 square millimeters, 25 square millimeters, or 9 square millimeters. Thus the signal processor 13 can be easily integrated into the universal serial bus connector. Thus the integration degree can be improved, and cables between the signal processor 13 and the universal serial bus connector can be omitted. The driving voltage can also be reduced to lower than 5 V.

The signal processor 13 includes an audio signal processing unit 132, and a driving signal processing unit 134. The audio signal processing unit 132 can be electrically connected to the audio input port 16 via a second earphone cable 172. The driving signal processing unit 134 is electrically connected to the power connector 184. The audio signal processing unit 132 can amplify the audio signal and transfer the amplified audio signal into the thermoacoustic device 14. The driving signal processing unit 134 can bias the current from the power connector 184. Therefore, the double frequency of the loudspeaker 15 can be avoided, and the acoustic effect of the loudspeaker 15 can be improved.

The audio input port 16 can be a stereo headphone plug, and the diameter of the stereo headphone plug can be 2.5 millimeters (mm) or 3.5 mm. In one embodiment, the diameter of the stereo headphone plug is 3.5 mm, and can be electrically connected to a playback device (not shown). The audio signal from the playback device is transferred into the audio signal processing unit 132 via the stereo headphone plug.

The signal processor 13 can also be electrically connected to the audio input port 16 and the power connector 184 via an earphone cable (not shown). Furthermore, the signal processor 13 can also be integrated into an earphone controller (not shown) or the loudspeaker 15 of the earphone 10.

Figure 4:
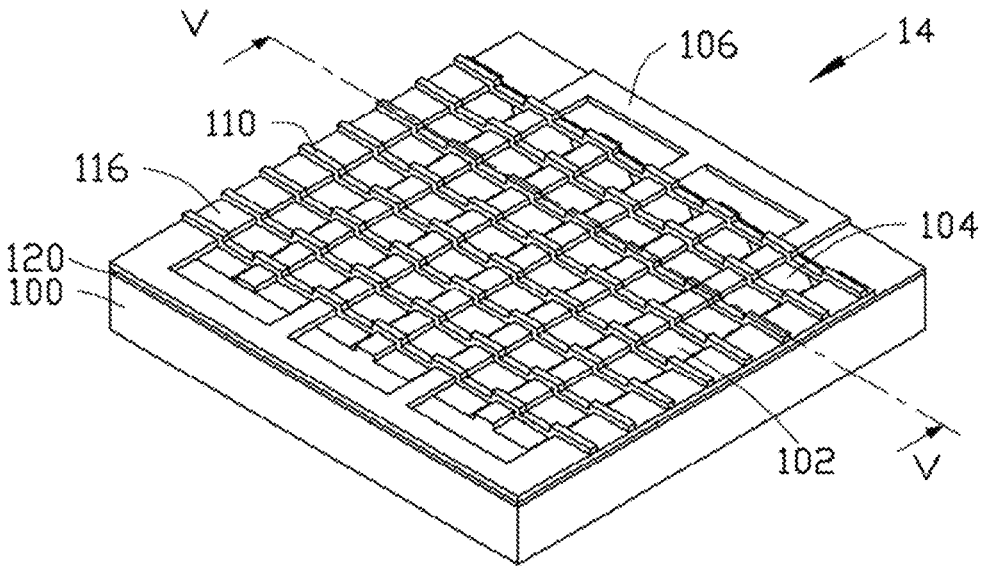
FIG. 4 shows a schematic structural view of a thermoacoustic device in the earphone.
Figure 5:
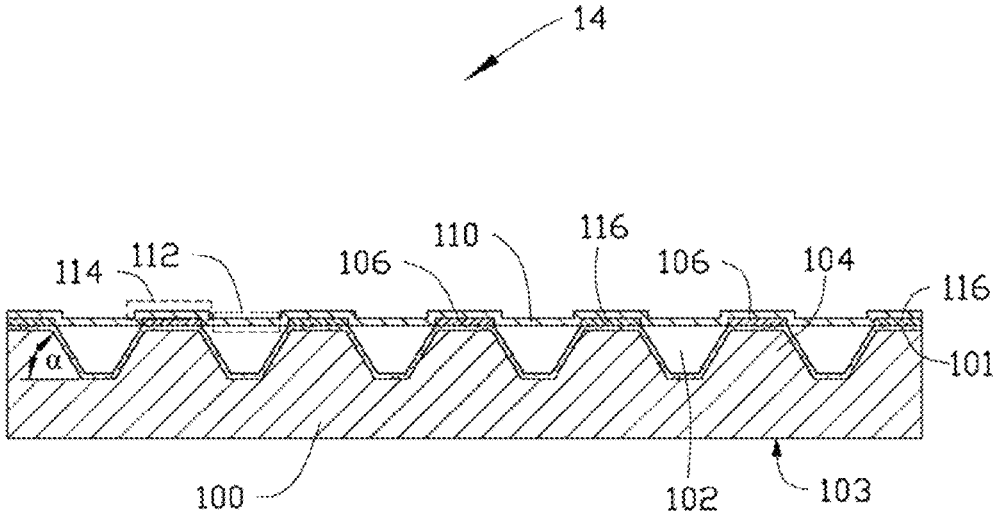
FIG. 5 shows a cross-sectional view, along line V-V of the thermoacoustic device of FIG. 4.
Figure 6:
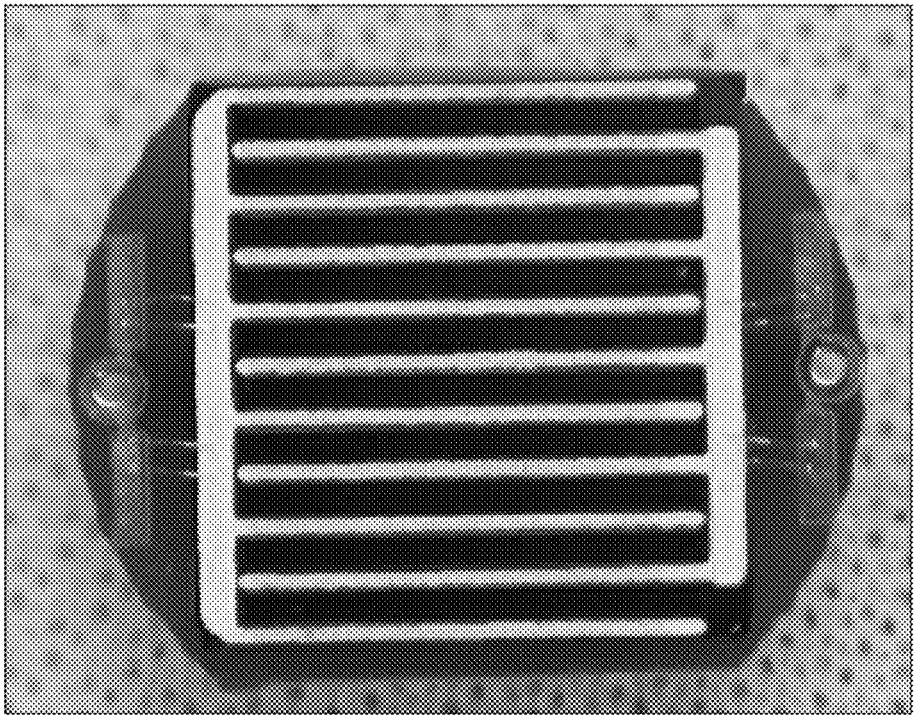
FIG. 6 is a photograph of the thermoacoustic device of FIG. 4.

FIGS. 4-6 show that the thermoacoustic device 14 includes a substrate 100, a sound wave generator 110, an insulating layer 120, a first electrode 106 and a second electrode 116. The first electrode 106 and the second electrode 116 are spaced from each other and electrically connected to the sound wave generator 110. The substrate 100 includes a first surface 101 and a second surface 103 opposite to the first surface 101. The first surface 101 defines a plurality of grooves 102, and a bulge 104 is formed between the adjacent two grooves 102. The insulating layer 120 is located on the first surface 101, and continuously attached on the plurality of grooves 102 and the bulge 104. The sound wave generator 110 is located on the insulating layer 120 and insulated from the substrate 100. The sound wave generator 110 defines a first portion 112 and a second portion 114. The first portion 112 is suspended on the plurality of grooves 102. The second portion 114 is attached on the bulge 104. The first electrode 106 and the second electrode 116 are electrically connected to the plurality of contact electrodes 125 to receive signals from the signal processor 13.

The substrate 100 is a flake-like structure. The shape of the substrate 100 can be circular, square, rectangular or other geometric figure. The resistance of the substrate 100 is greater than the resistance of the sound wave generator 110 to avoid a short through the substrate 100. The substrate 100 can have a good thermal insulating property, thereby preventing the substrate 100 from absorbing the heat generated by the sound wave generator 110. The material of the substrate 100 can be single crystal silicon or multicrystalline silicon. The size of the substrate 100 ranges from about 25 square millimeters to about 100 square millimeters. In one embodiment, the substrate 100 is single crystal silicon with a thickness is about 0.6 millimeters, and a length of each side of the substrate 100 is about 8 millimeters.

The plurality of grooves 102 can be uniformly dispersed on the first surface 101 such as dispersed in an array. The plurality of grooves 102 can also be randomly dispersed. In one embodiment, the plurality of grooves 102 extends along the same direction, and spaced from each other a certain distance. The shape of the groove 102 can be a through hole, a blind groove (i.e., a depth of the groove 102 is less than a thickness of the substrate 100), a blind hole. Each of the plurality of grooves 102 includes a bottom and a sidewall adjacent to the bottom. The first portion 112 is spaced from the bottom and the sidewall.

Figure 7:
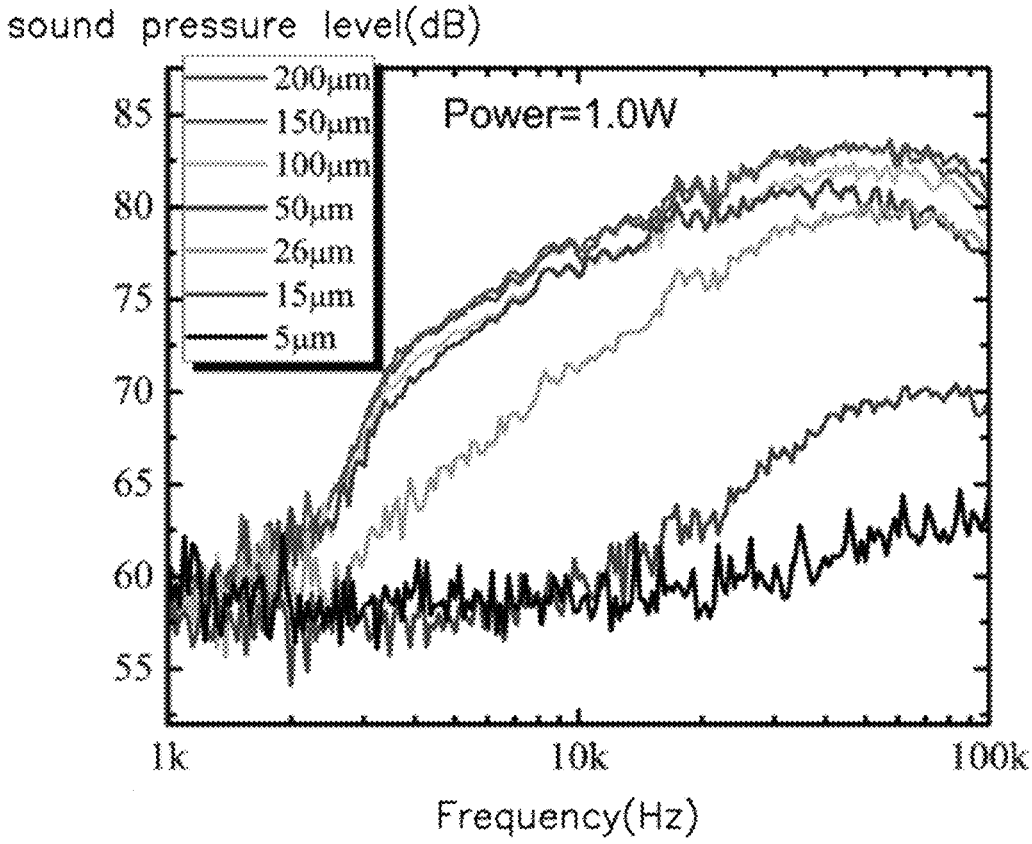
FIG. 7 shows a sound pressure level vs frequency curve of the thermoacoustic device of FIG. 4.
Figure 8:
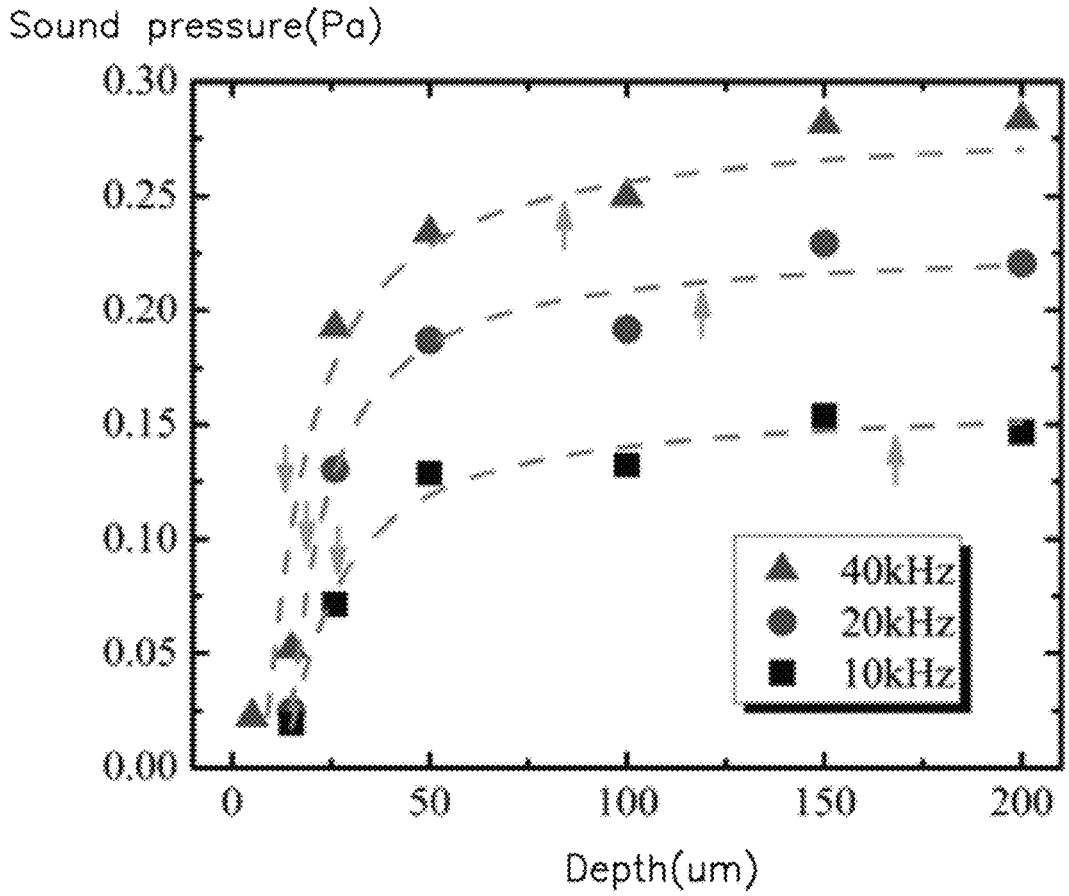
FIG. 8 shows is a diagram of acoustic effects of the thermoacoustic device of FIG. 4.

FIGS. 7-8 show that a depth of the groove 102 can range from about 100 micrometers to about 200 micrometers. The sound waves reflected by the bottom surface of the blind grooves may have a superposition with the original sound waves, which may lead to an interference cancellation. To reduce this impact, the depth of the blind grooves that can be less than about 200 micrometers. In another aspect, when the depth of the blind grooves is less than 100 micrometers, the heat generated by the sound wave generator 110 would be dissipated insufficiently. To reduce this impact, the depth of the blind grooves and holes can be greater than 100 micrometers.

The plurality of grooves 102 can parallel with each other and extend along the same direction. A distance $d_1$ between adjacent two grooves 102 can range from about 20 micrometers to about 200 micrometers. Thus the first electrode 106 and the second electrode 116 can be printed on the substrate 100 via nanoimprinting method. A cross section of the groove 102 along the extending direction can be V-shaped, rectangular, or trapezoid. In one embodiment, a width of the groove 102 can range from about 0.2 millimeters to about 1 micrometer. Thus sound wave generator 110 can be prevented from being broken. Furthermore, a driven voltage of the sound wave generator 110 can be reduced to lower than 12V. In one embodiment, the driven voltage of the sound wave generator 110 is lower than or equal to 5V. In one embodiment, the shape of the groove 102 is trapezoid. An angle $\alpha$ is defined between the sidewall and the bottom. The angle $\alpha$ is equal to the crystal plane angle of the substrate 100. In one embodiment, the width of the groove 102 is about 0.6 millimeters, the depth of the groove 102 is about 150 micrometers, the distance $d_1$ between adjacent two grooves 102 is about 100 micrometers, and the angle $\alpha$ is about 54.7 degrees.

The insulating layer 120 can be a single-layer structure or a multi-layer structure. In one embodiment, the insulating layer 120 can be merely located on the plurality of bulges 104. In another embodiment, the insulating layer 120 is a continuous structure, and attached on the entire first surface 101. The insulating layer 120 covers the plurality of grooves 102 and the plurality of bulges 104. The sound wave generator 110 is insulated from the substrate 100 by the insulating layer 120. In one embodiment, the insulating layer 120 is a single-layer structure and covers the entire first surface 101.

The material of the insulating layer 120 can be $SiO_2$, $Si_3N_4$, or combination of them. The material of the insulating layer 120 can also be other insulating materials. A thickness of the insulating layer 120 can range from about 10 nanometers to about 2 micrometers, such as 50 nanometers, 90 nanometers, and 1 micrometer. In one embodiment, the thickness of the insulating layer is about 1.2 micrometers.

Figure 9:
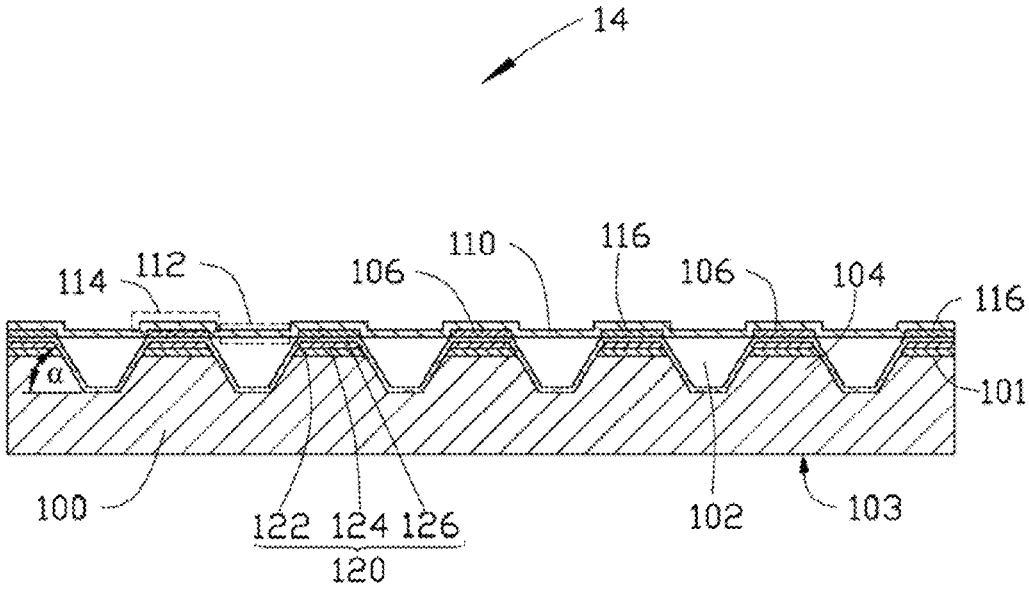
FIG. 9 shows a schematic view of one embodiment of multi-layer insulating layer in a thermoacoustic device.

Referring to FIG. 9, the insulating layer 120 can also be a multi-layer structure. The insulating layer 120 includes a first insulating layer 122, a second insulating layer 124, and a third insulating layer 126 stacked on the substrate 100 in that sequence. In one embodiment, the first insulating layer 122 and the second insulating layer 124 are merely coated on the plurality of bulges 104, and the third insulating layer 126 covers the entire first surface 101.

The insulating material of the first insulating layer 122, the second insulating layer 124, and the third insulating layer 126 can be same or different. The thickness of each sub-layer of the insulating layer 120 can range from about 10 nanometers to about 1 micrometer. In one embodiment, the material of the first insulating layer 122 is silicon in a thickness about 100 nanometers, the material of the second insulating layer 124 is silicon nitride in a thickness about 90 nanometers, and the material of the third insulating layer 126 is silicon dioxide in a thickness about 1 micrometer. The multi-layer insulating layer 120 can absolutely insulate the substrate 100 from the sound wave generator 110, and reduce the oxidation of the substrate 100 during fabricating process.

Figure 10:
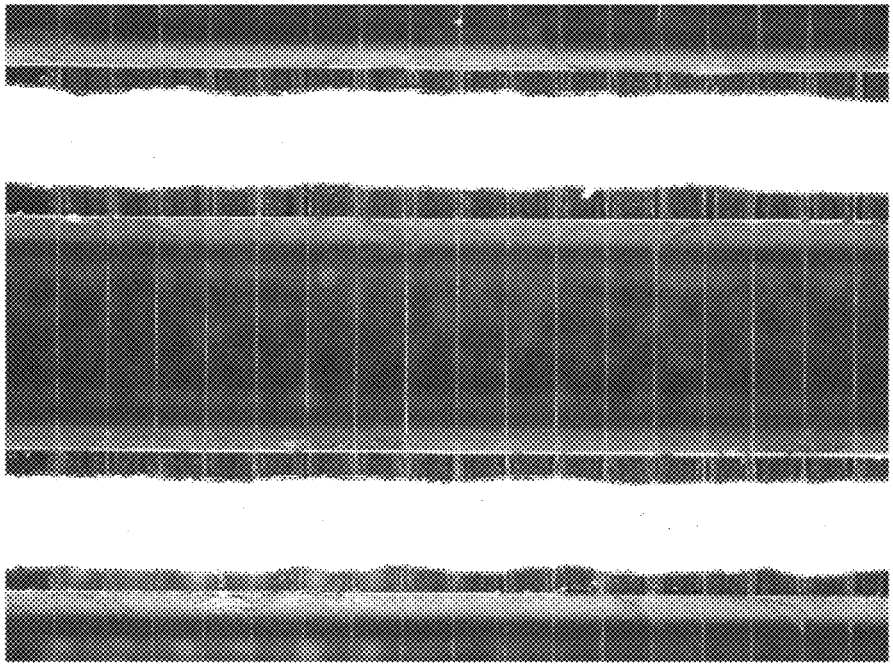
FIG. 10 shows a photomicrograph of a sound wave generator in the earphone.

FIG. 10 shows that the sound wave generator 110 is located on the first surface 101 and insulated from the substrate 100 by the insulating layer 120. The first portion 112 is suspended above the plurality of grooves 102, and the second portion 114 is attached on the plurality of bulges 104. The second portion 114 can be attached on the plurality of bulges 104 via an adhesive layer or adhesive particles (not shown).

The sound wave generator 110 has a very small heat capacity per unit area. The heat capacity per unit area of the sound wave generator 110 is less than $2\times10^{-4}$ J/cm$^2$*K. The sound wave generator 110 can be a conductive structure with a small heat capacity per unit area and a small thickness. The sound wave generator 110 can have a large specific surface area for causing the pressure oscillation in the surrounding medium by the temperature waves generated by the sound wave generator 110. The sound wave generator 110 can be a free-standing structure. The term "free-standing" includes, but is not limited to, a structure that does not have to be supported by a substrate and can be lifted by a portion thereof and stain the weight thereof without any significant damage to its structural integrity. The suspended part of the sound wave generator 110 will have more sufficient contact with the surrounding medium (e.g., air) to have heat exchange with the surrounding medium from both sides of the sound wave generator 110. The sound wave generator 110 is a thermoacoustic film.

The sound wave generator 110 can be or include a free-standing carbon nanotube structure. The carbon nanotube structure may have a film structure. The thickness of the carbon nanotube structure may range from about 0.5 nanometers to about 1 millimeter. The carbon nanotubes in the carbon nanotube structure are combined by van der Waals force therebetween. The carbon nanotube structure has a large specific surface area (e.g., above 30 m$^2$/g). The larger the specific surface area of the carbon nanotube structure, the smaller the heat capacity per unit area will be. The smaller the heat capacity per unit area, the higher the sound pressure level of the sound produced by the sound wave generator 110.

The carbon nanotube structure can include at least one carbon nanotube film, a plurality of carbon nanotube wires, or a combination of carbon nanotube film and the plurality of carbon nanotube wires. The carbon nanotube film can be a drawn carbon nanotube film formed by drawing a film from a carbon nanotube array that is capable of having a film drawn therefrom. The heat capacity per unit area of the drawn carbon nanotube film can be less than or equal to about $1.7\times10^{-6}$ J/cm$^2$*K. The drawn carbon nanotube film can have a large specific surface area (e.g., above 100 m$^2$/g). In one embodiment, the drawn carbon nanotube film has a specific surface area in the range from about 200 m$^2$/g to about 2600 m$^2$/g. In one embodiment, the drawn carbon nanotube film has a specific weight of about 0.05 g/m$^2$.

The thickness of the drawn carbon nanotube film can be in a range from about 0.5 nanometers to about 100 nanometers. When the thickness of the drawn carbon nanotube film is small enough (e.g., smaller than 10 μm), the drawn carbon nanotube film is substantially transparent.

Figure 11:
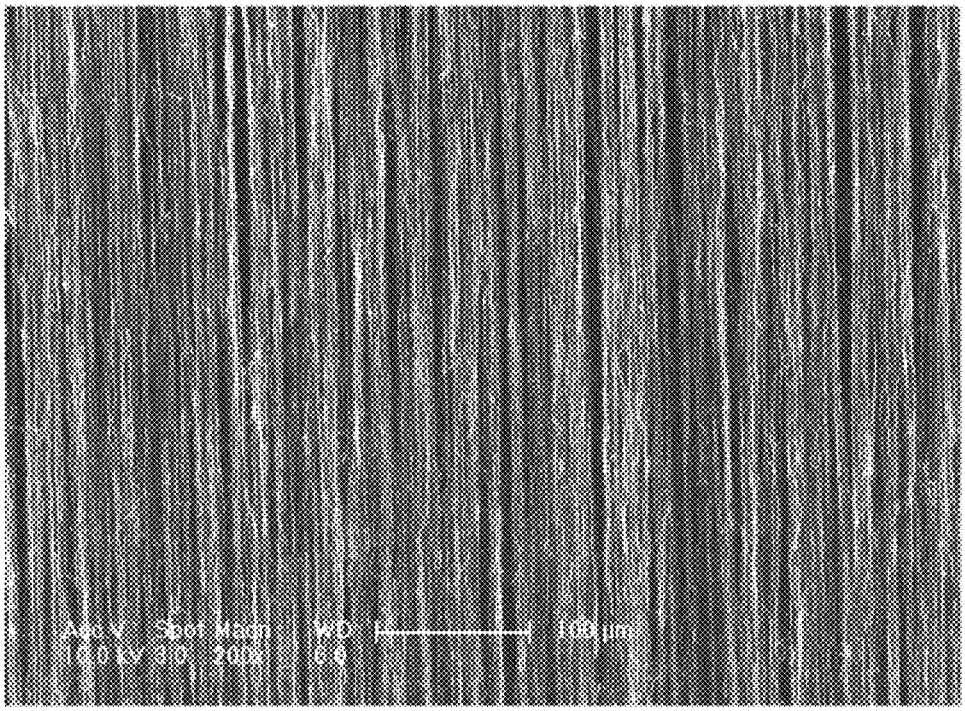
FIG. 11 shows a Scanning Electron Microscope (SEM) image of a drawn carbon nanotube film in one embodiment of the earphone.

FIG. 11 shows that the drawn carbon nanotube film includes a plurality of successive and oriented carbon nanotubes joined end-to-end by van der Waals attractive force therebetween. The carbon nanotubes in the drawn carbon nanotube film can be substantially oriented along a single direction and substantially parallel to the surface of the carbon nanotube film. Furthermore, an angle β can exist between the oriented direction of the carbon nanotubes in the drawn carbon nanotube film and the extending direction of the plurality of grooves 102, and $0\leq\beta\leq90°$. In one embodiment, the oriented direction of the plurality of carbon nanotubes is perpendicular to the extending direction of the plurality of grooves 102. As can be seen in FIG. 11, some variations can occur in the drawn carbon nanotube film. The drawn carbon nanotube film is a free-standing film. The drawn carbon nanotube film can be formed by drawing a film from a carbon nanotube array that will allow a carbon nanotube film to be drawn therefrom. Furthermore, the plurality of carbon nanotubes is substantially parallel with the first face 101.

The carbon nanotube structure can include more than one carbon nanotube films. The carbon nanotube films in the carbon nanotube structure can be coplanar and/or stacked. Coplanar carbon nanotube films can also be stacked one upon other coplanar films. Additionally, an angle can exist between the orientation of carbon nanotubes in adjacent films, stacked and/or coplanar. Adjacent carbon nanotube films can be combined by only the van der Waals attractive force therebetween without the need of an additional adhesive. The number of the layers of the carbon nanotube films is not limited. However, as the stacked number of the carbon nanotube films increases, the specific surface area of the carbon nanotube structure will decrease. A large enough specific surface area (e.g., above 30 m$^2$/g) must be maintained to achieve an acceptable acoustic volume. An angle θ between the aligned directions of the carbon nanotubes in the two adjacent drawn carbon nanotube films can range from about 0 degrees to about 90 degrees. Spaces are defined between two adjacent carbon nanotubes in the drawn carbon nanotube film. When the angle θ between the aligned directions of the carbon nanotubes in adjacent drawn carbon nanotube films is larger than 0 degrees, a microporous structure is defined by the carbon nanotubes in the sound wave generator 110. The carbon nanotube structure in an embodiment employing these films will have a plurality of micropores. Stacking the carbon nanotube films will add to the structural integrity of the carbon nanotube structure.

In some embodiments, the sound wave generator 110 is a single drawn carbon nanotube film drawn from the carbon nanotube array. The drawn carbon nanotube film has a thickness of about 50 nanometers, and has a transmittance of visible lights in a range from 67% to 95%.

In other embodiments, the sound wave generator 110 can be or include a free-standing carbon nanotube composite structure. The carbon nanotube composite structure can be formed by depositing at least a conductive layer on the outer surface of the individual carbon nanotubes in the above-described carbon nanotube structure. The carbon nanotubes can be individually coated or partially covered with conductive material. Thereby, the carbon nanotube composite structure can inherit the properties of the carbon nanotube structure such as the large specific surface area, the high transparency, the small heat capacity per unit area. Further, the conductivity of the carbon nanotube composite structure is greater than the pure carbon nanotube structure. Thereby, the driven voltage of the sound wave generator 110 using a coated carbon nanotube composite structure will be decreased. The conductive material can be placed on the carbon nanotubes by using a method of vacuum evaporation, spattering, chemical vapor deposition (CVD), electroplating, or electroless plating.

The first electrode 106 and the second electrode 116 are in electrical contact with the sound wave generator 110, and input electrical signals into the sound wave generator 110.

The first electrode 106 and the second electrode 116 are made of conductive material. The shape of the first electrode 106 or the second electrode 116 is not limited and can be lamellar, rod, wire, and block among other shapes. A material of the first electrode 106 or the second electrode 116 can be metals, conductive adhesives, carbon nanotubes, and indium tin oxides among other conductive materials. The first electrode 106 and the second electrode 116 can be metal wire or conductive material layers, such as metal layers formed by a sputtering method, or conductive paste layers formed by a method of screen-printing.

In one embodiment, the sound wave generator 110 is a drawn carbon nanotube film drawn from the carbon nanotube array, and the carbon nanotubes in the carbon nanotube film are aligned along a direction from the first electrode 106 to the second electrode 116. The first electrode 106 and the second electrode 116 can both have a length greater than or equal to the carbon nanotube film width.

Furthermore, a heat sink (not shown) can be located on the substrate 100, and the heat produced by the sound wave generator 110 can be transferred into the heat sink and the temperature of the sound wave generator 110 can be reduced.

The sound wave generator 110 is driven by electrical signals and converts the electrical signals into heat energy. The heat capacity per unit area of the carbon nanotube structure is extremely small, and thus, the temperature of the carbon nanotube structure can change rapidly. Thermal waves, which are propagated into surrounding medium, are obtained. Therefore, the surrounding medium, such as ambient air, can be heated at a frequency. The thermal waves produce pressure waves in the surrounding medium, resulting in sound wave generation. In this process, it is the thermal expansion and contraction of the medium in the vicinity of the sound wave generator 110 that produces sound. The operating principle of the sound wave generator 110 is the "optical-thermal-sound" conversion.

Figure 12:
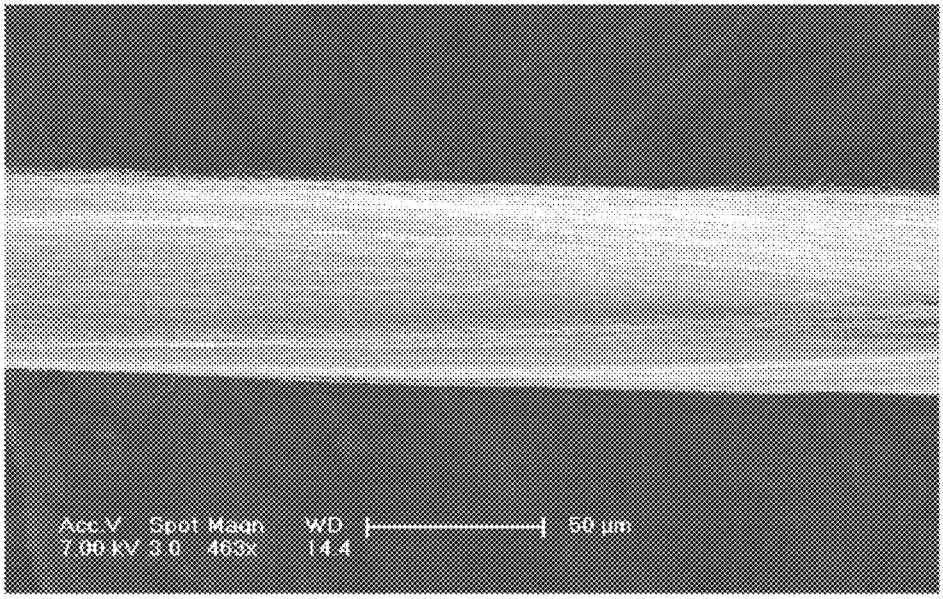
FIG. 12 shows an SEM image of an untwisted carbon nanotube wire in one embodiment of the drawn carbon nanotube film.

FIG. 12 shows that the sound wave generator 110 can also include a plurality of carbon nanotube wires parallel with and spaced from each other. The plurality of carbon nanotube wires is intersected with the plurality of grooves 102. In one embodiment, the plurality of carbon nanotube wires is perpendicular to the plurality of grooves 102. Each of the plurality of carbon nanotube wires includes a plurality of carbon nanotubes extending parallel with the carbon nanotube wire. The plurality of carbon nanotube wires is suspended on the plurality of grooves 102.

A distance between adjacent two carbon nanotube wires ranges from about 1 micrometers to about 200 micrometers, such as 50 micrometers, 150 micrometers. In one embodiment, the distance between adjacent two carbon nanotube wires is about 120 micrometers. A diameter of the carbon nanotube wire ranges from about 0.5 nanometers to about 100 micrometers. In one embodiment, the distance between adjacent two carbon nanotube wires is about 120 micrometers, and the diameter of the carbon nanotube wire is about 1 micrometer.

The carbon nanotube wire can be untwisted or twisted. Treating the drawn carbon nanotube film with a volatile organic solvent can form the untwisted carbon nanotube wire. Specifically, the organic solvent is applied to soak the entire surface of the drawn carbon nanotube film. During the soaking, adjacent parallel carbon nanotubes in the drawn carbon nanotube film will bundle together, due to the surface tension of the organic solvent as it volatilizes, and thus, the drawn carbon nanotube film will be shrunk into untwisted carbon nanotube wire. FIG. 12 shows that the untwisted carbon nanotube wire includes a plurality of carbon nanotubes substantially oriented along a same direction (i.e., a direction along the length of the untwisted carbon nanotube wire). The carbon nanotubes are parallel to the axis of the untwisted carbon nanotube wire. More specifically, the untwisted carbon nanotube wire includes a plurality of successive carbon nanotube segments joined end to end by van der Waals force therebetween. Each carbon nanotube segment includes a plurality of carbon nanotubes substantially parallel to each other, and combined by van der Waals force therebetween. The carbon nanotube segments can vary in width, thickness, uniformity and shape. Length of the untwisted carbon nanotube wire can be arbitrarily set as desired. A diameter of the untwisted carbon nanotube wire ranges from about 0.5 nm to about 100 μm.

Figure 13:
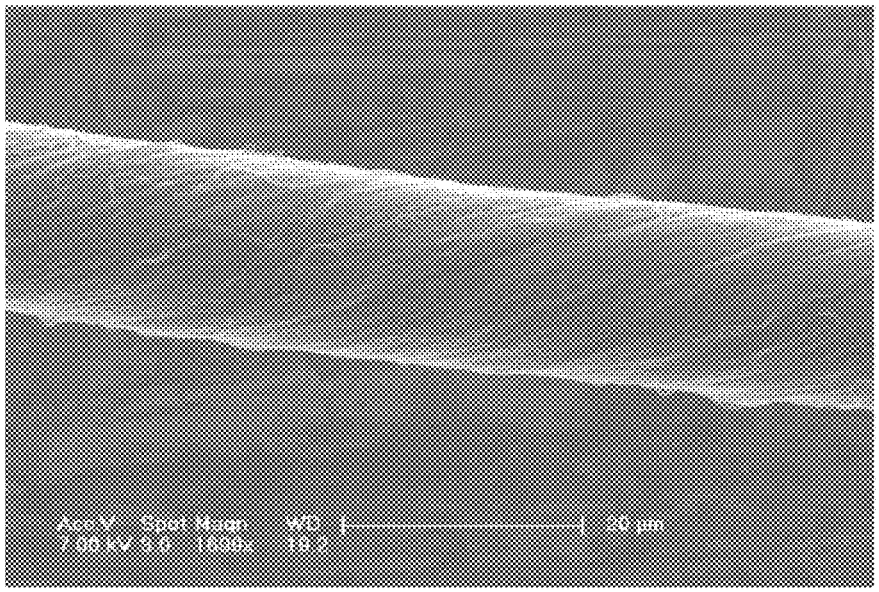
FIG. 13 shows an SEM image of a twisted carbon nanotube wire in another embodiment of the drawn carbon nanotube film.

The twisted carbon nanotube wire can be formed by twisting a drawn carbon nanotube film using a mechanical force to turn the two ends of the drawn carbon nanotube film in opposite directions. FIG. 13 shows that the twisted carbon nanotube wire includes a plurality of carbon nanotubes helically oriented around an axial direction of the twisted carbon nanotube wire. More specifically, the twisted carbon nanotube wire includes a plurality of successive carbon nanotube segments joined end to end by van der Waals force therebetween. Each carbon nanotube segment includes a plurality of carbon nanotubes parallel to each other, and combined by van der Waals force therebetween. Length of the carbon nanotube wire can be set as desired. A diameter of the twisted carbon nanotube wire can be from about 0.5 nm to about 100 μm. Further, the twisted carbon nanotube wire can be treated with a volatile organic solvent after being twisted. After being soaked by the organic solvent, the adjacent paralleled carbon nanotubes in the twisted carbon nanotube wire will bundle together, due to the surface tension of the organic solvent when the organic solvent is volatilizing. The specific surface area of the twisted carbon nanotube wire will decrease, while the density and strength of the twisted carbon nanotube wire will be increased. The deformation of the sound wave generator 110 can be avoided during working, and the distortion degree of the sound wave can be reduced.

Furthermore, the substrate 100 is silicon, thus the signal processor 13 can be directly integrated into the substrate 100. As such, the signal processor 13 can be integrated into the first surface 101 or the second surface 103. The signal processor 13 can be integrated in to the substrate 100 via traditional microelectronics process such as epitaxial technology, diffusion technology, ion implantation doping, oxide process, lithography process, or depositing process.

Furthermore, the signal processor 13 can provide signal to the loudspeaker 15 via wireless device such as BLUETOOTH device (not shown), thus the earphone cable 171 can be omitted. In another embodiment, the signal processor 13 can also connected to the playback device via wireless device such as BLUETOOTH device, thus the earphone cable 172 can also be omitted.

The material of the substrate 100 is silicon material, thus the thermoacoustic device 14 can be fabricated with traditional semiconductor manufacturing process, thus the thermoacoustic device 14 can be easily integrated with other elements such as IC chip, and suitable for small-sized device, and the size of the thermoacoustic device 14 can be reduced, and small-sized loudspeaker 15 (such as smaller than 1 square centimeters) can be obtained. Furthermore, the substrate 100 has good thermal conductivity, and the heat sink can be omitted.

Figure 14:
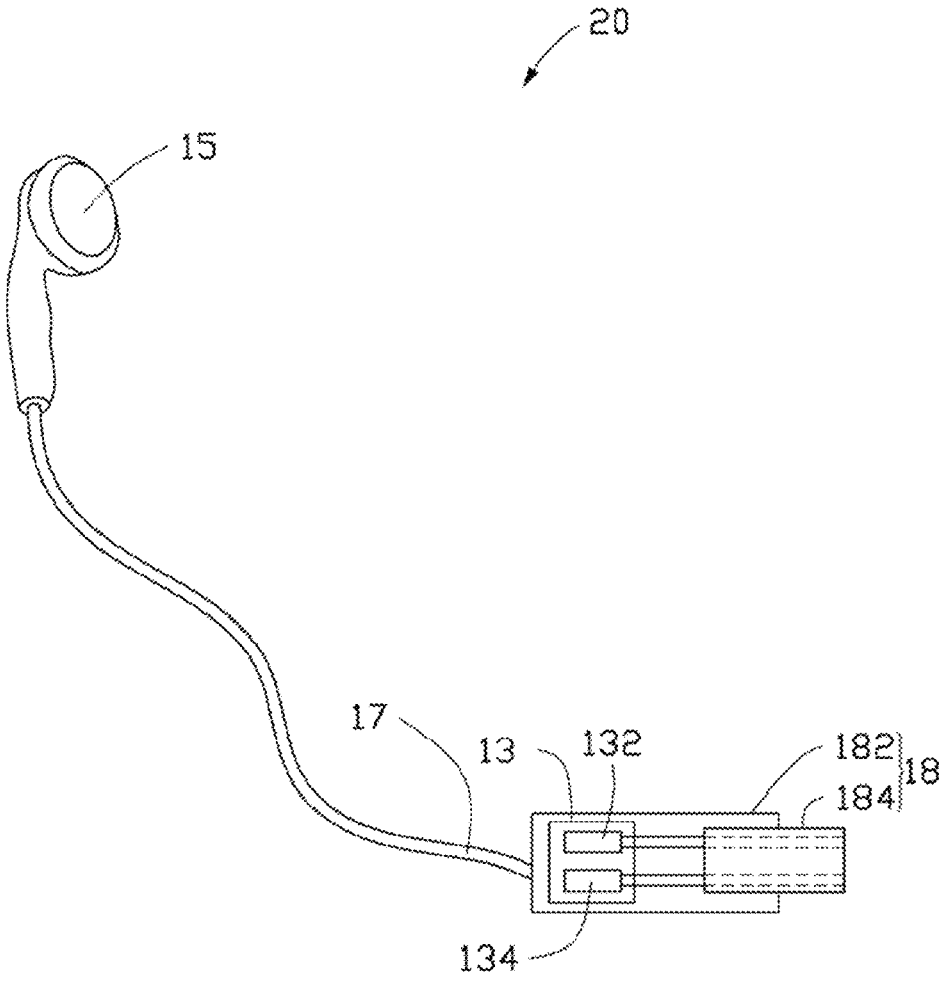
FIG. 14 is a schematic structural view of an earphone in another embodiment.

FIG. 14 shows that an earphone 20 of one embodiment includes a loudspeaker 15, a driving port 18, and a signal processor 13. The signal processor 13 is electrically connected to the loudspeaker 15 via an earphone cable 17. The signal processor 13 includes an audio signal processing unit 132, and a driving signal processing unit 134. The driving port 18 includes a shell 182 and a power connector 184. The signal processor 13 can be accommodated into the shell 182, and electrically connected to the power connector 184.

The structure of earphone 20 is similar to the structure of earphone 10, except that the audio input port is omitted. The power connector 184 is configured to supply both the audio signal and the driving current into the signal processor 13. The power connector 184 includes a signal input circuit and a driving current input circuit. The signal input circuit is electrically connected to the audio signal processing unit 132 to supply audio signal from a playback device (not shown), and the driving current input circuit is electrically connected to the driving signal processing unit 134 to supply driving current from the play back device. In one embodiment, the driving port 18 can be universal series bus connector. Thus the audio input port can be omitted, and the earphone cable between the audio input port and the signal processor 13 can be omitted. Therefore, the resistance of the earphone 20 can be reduced, and low cost.

Figure 15:
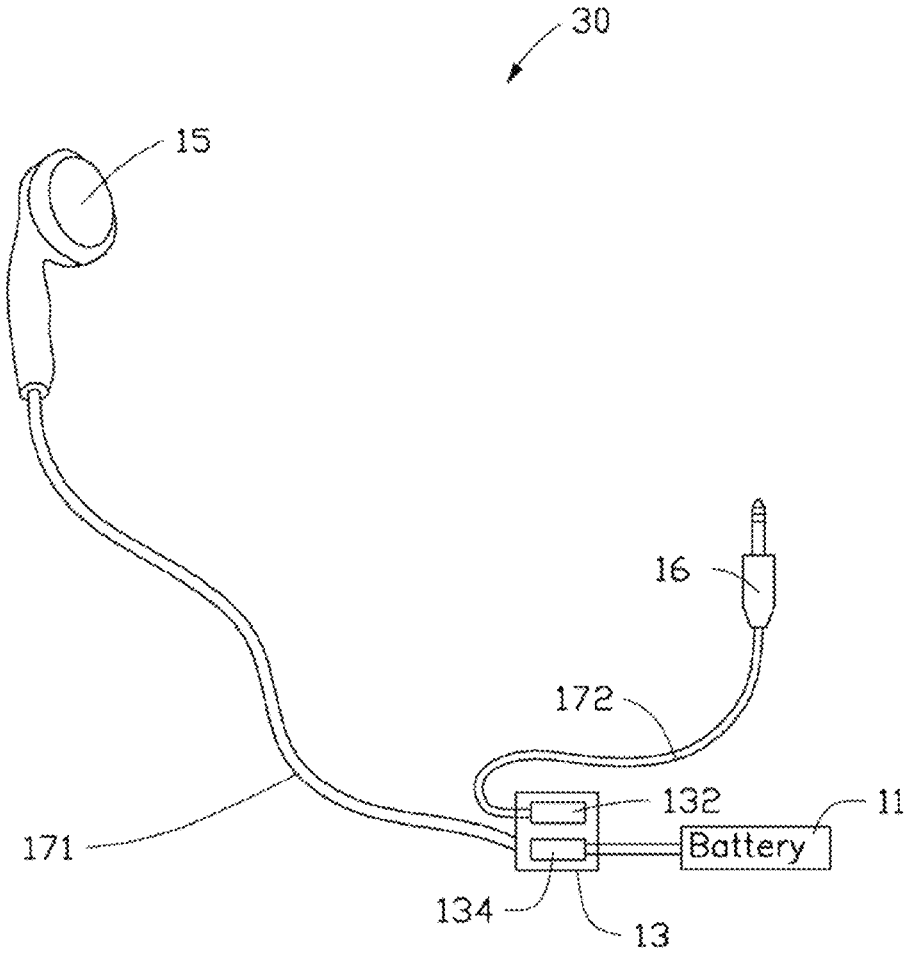
FIG. 15 is a schematic structural view of an earphone in another embodiment.

FIG. 15 shows that an earphone 30 of one embodiment includes a loudspeaker 15, an audio input port 16, a signal processor 13, and a power supply device 11. The loudspeaker 15 is electrically connected to the signal processor 13 via a first earphone cable 171, and the audio input port 16 is electrically connected to the driving port 18 via a second earphone cable 172. The audio input port 16 is used to transfer the audio signal into the loudspeaker 15, and the power supply device 11 is used to supply driving current into the signal processor 13.

The structure of the earphone 30 is similar to the structure of earphone 10, except that the driving port is omitted, and the power supply device 11 is configured to supply driving current.

The power supply device 11 can be disposable battery or secondary battery, such as solar cells, piezoelectric cell, photosensitizer battery, thermosensitive battery, lead-acid batteries, nickel cadmium batteries, manganese dioxide batteries, or lithium batteries. The power supply device 11 can be integrated into the loudspeaker 15. In one embodiment, the power supply device 11 can be the solar cell attached on the outer surface of the loudspeaker 15. Furthermore, the power supply device 11 such as solar cells, can also be fixed in the loudspeaker 15, and one part of the power supply device 11 is exposed out of the loudspeaker 15 to receive sunshine. Because the power supply device 11 can be integrated into the earphone 30, therefore the earphone 30 is not depended on the fixed power to work, and the mobility of the earphone 30 can be improved. Thus the application of the earphone 30 can be convenient.

Depending on the embodiment, certain of the steps of methods described may be removed, others may be added, and the sequence of steps may be altered. It is also to be understood that the description and the claims drawn to a method may include some indication in reference to certain steps. However, the indication used is only to be viewed for identification purposes and not as a suggestion as to an order for the steps.

It is to be understood that the above-described embodiments are intended to illustrate rather than limit the invention. Variations may be made to the embodiments without departing from the spirit of the invention as claimed. Any elements discussed with any embodiment are envisioned to be able to be used with the other embodiments. The above-described embodiments illustrate the scope of the invention but do not restrict the scope of the invention.

What is claimed is:

1. An earphone comprising:

a thermoacoustic device comprising a substrate comprising a first surface defining a plurality of grooves, a second surface opposite to the first surface, and a sound wave generator on the first surface, wherein the sound wave generator is partially suspended over the plurality of grooves;

a loudspeaker, the loudspeaker comprising a housing configured to accommodate the thermoacoustic device;

a signal processor electrically connected to the loudspeaker and configured to provide signals to the loudspeaker;

an audio input port electrically connected to the signal processor and configured to provide audio signals; and a driving port electrically connected to the signal processor, the driving port is adapted to provide driving signals.

2. The earphone of claim 1, wherein the driving port is a universal serial bus connector, and the signal processor is integrated into the universal serial bus connector.

3. The earphone of claim 2, wherein the driving port comprises a shell and a power connector accommodated in the shell, and the signal processor is accommodated in the shell and electrically connected to the power connector.

4. The earphone of claim 1, wherein the signal processor and the loudspeaker are configured to be integrated into each other.

5. The earphone of claim 1, wherein a material of the substrate of the thermoacoustic device is silicon, and the signal processor is integrated in the substrate.

6. The earphone of claim 5, wherein a size of the substrate ranges from about 25 square millimeters to about 100 square millimeters.

7. The earphone of claim 1, wherein the signal processor comprises an audio signal processing unit and a driving signal processing unit electrically connected to the loudspeaker.

8. The earphone of claim 7, wherein the audio signal processing unit is electrically connected to the audio input port, and the driving signal processing unit is electrically connected to the driving port.

9. The earphone of claim 1, wherein a depth of each of the plurality of grooves ranges from about 100 micrometers to about 200 micrometers, and a width of each of the plurality of grooves ranges from about 0.2 millimeters to about 1 millimeter.

10. The earphone of claim 1, wherein the plurality of grooves is parallel with each other and extends along a first direction.

11. The earphone of claim 10, wherein the sound wave generator comprises a plurality of carbon nanotube wires extending along a second direction, and the second direction intersects with the first direction.

12. The earphone of claim 11, wherein a distance between adjacent two of the carbon nanotube wires ranges from about 0.1 micrometers to about 200 micrometers.

13. The earphone of claim 1, wherein the sound wave generator is insulated from the substrate by an insulating layer, and the insulating layer comprises a first insulating layer, a second insulating layer, and a third insulating layer, the first, the second and the third insulating layers are sequentially stacked on the first surface.

14. The earphone of claim 1, wherein the sound wave generator comprises a carbon nanotube film, and the carbon nanotube film comprises a plurality of carbon nanotubes substantially aligned along a same direction.

15. The earphone of claim 14, wherein the plurality of carbon nanotubes is parallel with the first surface and aligned substantially perpendicular to the plurality of grooves.

16. The earphone of claim 1, wherein the thermoacoustic device further comprises a first electrode and a second electrode, the first and the second electrodes are spaced from each other and electrically connected to the sound wave generator, and the plurality of grooves is located between the first electrode and the second electrode.

17. The earphone of claim 1, wherein a plurality of first electrodes and a plurality of second electrodes are alternatively located on the sound wave generator and electrically connected to the sound wave generator.

18. The earphone of claim 17, wherein an opening is defined in the housing and configured to transfer sound waves out of the housing, and the sound wave generator faces to the opening.

19. A earphone comprising:

a loudspeaker, wherein the loudspeaker comprises a housing and a thermoacoustic device accommodate into the housing;

a signal processor adapted to transferring signals to the thermoacoustic device through an earphone cable or a wireless device;

an audio signal input port adapted to providing audio signals into the signal processor; and a driving port adapted to providing driving signals into the signal processor.

20. The earphone of claim 19, wherein the thermoacoustic device comprises a silicon substrate and a sound wave generator on the substrate, and the silicon substrate defines a plurality of grooves, the sound wave generator comprises a carbon nanotube film suspended over the plurality of grooves.

* * * * *